US009027650B2

(12) United States Patent
Radford et al.

(10) Patent No.: US 9,027,650 B2
(45) Date of Patent: May 12, 2015

(54) REMOTELY-CONTROLLED DOWNHOLE DEVICE AND METHOD FOR USING SAME

(75) Inventors: Steven R. Radford, The Woodlands, TX (US); John G. Evans, The Woodlands, TX (US); Bruce Stauffer, Spring, TX (US); Johannes Witte, Braunschweig (DE)

(73) Assignee: Baker Hughes Incorporated, Houston, TX (US)

( * ) Notice: Subject to any disclaimer, the term of this patent is extended or adjusted under 35 U.S.C. 154(b) by 898 days.

(21) Appl. No.: 13/217,939

(22) Filed: Aug. 25, 2011

(65) Prior Publication Data

US 2012/0048571 A1 Mar. 1, 2012

Related U.S. Application Data

(60) Provisional application No. 61/377,146, filed on Aug. 26, 2010.

(51) Int. Cl.

| | |
|---|---|
| ***E21B 10/32*** | (2006.01) |
| ***E21B 47/12*** | (2012.01) |
| ***E21B 23/04*** | (2006.01) |
| ***E21B 34/06*** | (2006.01) |

(52) U.S. Cl.

CPC ..... *E21B 47/12* (2013.01); *E21B 10/322* (2013.01); *E21B 23/04* (2013.01); *E21B 34/06* (2013.01)

(58) Field of Classification Search

None

See application file for complete search history.

(56) References Cited

U.S. PATENT DOCUMENTS

| | | | | |
|---|---|---|---|---|
| 4,756,372 | A * | 7/1988 | Airey | 166/319 |
| 4,944,350 | A * | 7/1990 | Airey | 166/373 |
| 5,788,000 | A | 8/1998 | Maury et al. | |
| 7,757,787 | B2 * | 7/2010 | Mackay et al. | 175/269 |
| 2006/0207797 | A1 | 9/2006 | Dewey et al. | |
| 2008/0128174 | A1 | 6/2008 | Radford et al. | |
| 2010/0006339 | A1 | 1/2010 | Desai | |
| 2010/0089583 | A1 * | 4/2010 | Xu et al. | 166/298 |

OTHER PUBLICATIONS

International Search Report and Written Opinion dated Jan. 4, 2012 for International Application No. PCT/US2011/049348; all references are cited above.

* cited by examiner

*Primary Examiner* — Jennifer H Gay
*Assistant Examiner* — Caroline Butcher
(74) *Attorney, Agent, or Firm* — Cantor Colburn LLP

(57) ABSTRACT

An apparatus for use downhole is disclosed. The apparatus includes a downhole device and an actuation device that includes: a housing including an annular chamber configured to house a first fluid therein and a piston in the annular chamber that divides the annular chamber into a first section and a second section. The piston is to a biasing member. A control unit enables movement of the first fluid from the first section to the second section to supply a second fluid under pressure to the tool to move the tool into an active position and from the second section to the first section to stop the supply of the second fluid to the tool to cause the tool to move into an inactive position.

20 Claims, 4 Drawing Sheets

REMOTELY-CONTROLLED DOWNHOLE DEVICE AND METHOD FOR USING SAME

CROSS-REFERENCE TO RELATED APPLICATION

This application takes priority from U.S. Provisional application Ser. No. 61/377,146, filed on Aug. 26, 2010, which is incorporated herein in its entirety by reference.

BACKGROUND

1. Field of the Disclosure

This disclosure relates generally to downhole tools that may be actuated from a remote location, such as the surface.

2. Background of the Art

Oil wells (also referred to as wellbores or boreholes) are drilled with a drill string that includes a tubular member (also referred to as a drilling tubular) having a drilling assembly (also referred to as the drilling assembly or bottomhole assembly or "BHA") which includes a drill bit attached to the bottom end thereof. The drill bit is rotated to disintegrate the rock formation to drill the wellbore. The drill string often includes tools or devices that need to be remotely activated and deactivated during drilling operations. Such devices include, among other things, reamers, stabilizer or force application members used for steering the drill bit, Production wells include devices, such as valves, inflow control device, etc. that are remotely controlled. The disclosure herein provides a novel apparatus for controlling such and other downhole tools or devices.

SUMMARY

In one aspect, an apparatus for use downhole is disclosed that in one configuration includes a downhole tool configured to be in an active position and an inactive position and an actuation device that includes: a housing including an annular chamber configured to house a first fluid therein, a piston in the annular chamber configured to divide the annular chamber into a first section and a second section, the piston being coupled to a biasing member, a control unit configured to move the first fluid from the first section to the second section to supply a second fluid under pressure to the tool to move the tool into the active position and from the second section to the first section to stop the supply of the second fluid to the tool to cause the tool to move into the inactive position. In another aspect, the apparatus includes a telemetry unit that sends a first pattern recognition signal to the control unit to move the tool in the active position and a second pattern recognition signal to move the tool in the inactive position.

The disclosure provides examples of various features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DETAILED DESCRIPTION OF THE EMBODIMENTS

Figure 1:
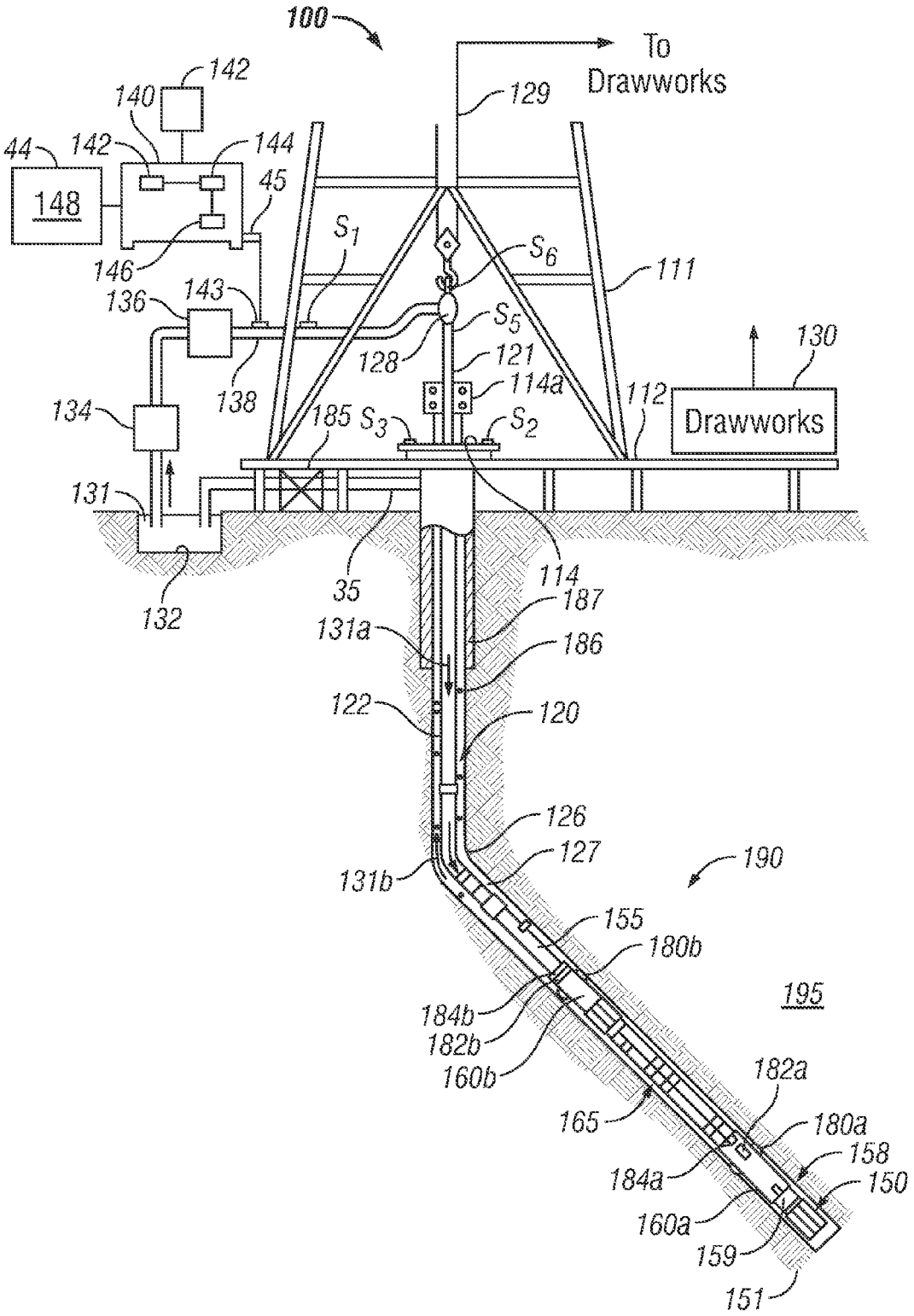
FIG. 1 is an elevation view of a drilling system including an actuation device, according to an embodiment of the present disclosure.

FIG. 1 is a schematic diagram of an exemplary drilling system 100 that includes a drill string having a drilling assembly attached to its bottom end that includes a steering unit according to one embodiment of the disclosure. FIG. 1 shows a drill string 120 that includes a drilling assembly or bottomhole assembly ("BHA") 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe) 122, having the drilling assembly 190 attached at its bottom end extends from the surface to the bottom 151 of the borehole 126. A drill bit 150, attached to drilling assembly 190, disintegrates the geological formations when it is rotated to drill the borehole 126. The drill string 120 is coupled to a draw works 130 via a Kelly joint 121, swivel 128 and line 129 through a pulley. Draw works 130 is operated to control the weight on bit ("WOB"). The drill string 120 may be rotated by a top drive (not shown) instead of by the prime mover and the rotary table 114. The operation of the draw works 130 is known in the art and is thus not described in detail herein.

In an aspect, a suitable drilling fluid 131 (also referred to as "mud") from a source 132 thereof, such as a mud pit, is circulated under pressure through the drill string 120 by a mud pump 134. The drilling fluid 131 passes from the mud pump 134 into the drill string 120 via a de-surger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 provide information about the torque and the rotational speed of the drill string 120. Rate of penetration of the drill string 120 may be determined from the sensor $S_5$, while the sensor $S_6$ may provide the hook load of the drill string 120.

In some applications, the drill bit 150 is rotated by rotating the drill pipe 122. However, in other applications, a downhole motor 155 (mud motor) disposed in the drilling assembly 190 also rotates the drill bit 150. In embodiments, the rotational speed of the drill string 120 is powered by both surface equipment and the downhole motor 155. The rate of penetration ("ROP") for a given drill bit and BHA largely depends on the WOB or the thrust force on the drill bit 150 and its rotational speed.

With continued reference to FIG. 1, a surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided from a program to the surface control unit 140. The surface control unit 140 displays desired drilling parameters and other information on a display/monitor 142 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with at least one remote control unit 148 located at another surface location. The surface control unit 140 may process data relating to the drilling operations, data from the sensors and devices on the surface, data received from downhole and may control one or more operations of the downhole and surface devices.

The drilling assembly 190 also contains formation evaluation sensors or devices (also referred to as measurement-while-drilling, "MWD," or logging-while-drilling, "LWD," sensors) determining resistivity, density, porosity, permeability, acoustic properties, nuclear-magnetic resonance properties, corrosive properties of the fluids or formation downhole, salt or saline content, and other selected properties of the formation 195 surrounding the drilling assembly 190. Such sensors are generally known in the art and for convenience are generally denoted herein by numeral 165. The drilling assembly 190 may further include a variety of other sensors and communication devices 159 for controlling and/or determining one or more functions and properties of the drilling assembly (such as velocity, vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.

Still referring to FIG. 1, the drill string 120 further includes one or more downhole tools 160*a* and 160*b*. In an aspect, the tool 160*a* is located in the BHA 190, and includes at least one reamer 180*a* to enlarge a wellbore 126 diameter as the BHA 190 penetrates the formation 195. In addition, the tool 160*b* may be positioned uphole of and coupled to the BHA 190, wherein the tool 160*b* includes a reamer 180*b*. In one embodiment, each reamer 180*a*, 180*b* is an expandable reamer that is selectively extended and retracted from the tool 160*a*, 160*b* to engage and disengage the wellbore wall. The reamers 180*a*, 180*b* may also stabilize the drilling assembly 190 during downhole operations. In an aspect, the actuation or movement of the reamers 180*a*, 180*b* is powered by an actuation device 182*a*, 182*b*, respectively. The actuation devices 182*a*, 182*b* are in turn controlled by controllers 184*a*, 184*b* positioned in or coupled to the actuation devices 182*a*, 182*b*. The controllers 184*a*, 184*b* may operate independently or may be in communication with other controllers, such as the surface controller 140. In one aspect, the surface controller 140 remotely controls the actuation of the reamers 180*a*, 180*b* via downhole controllers 184*a*, 184*b*, respectively. The controllers 184*a*, 184*b* may be a computer-based unit that may include a processor, a storage device, such as a solid-state memory, tape or hard disc, and one or more computer programs in the storage device that are accessible to the processor for executing instructions contained in such programs. It should be noted that the depicted reamers 180*a*, 180*b* are one example of a tool or apparatus that may be actuated or powered by the actuation devices 182*a*, 182*b*, which are described in detail below. In some embodiments, the drilling system 100 may utilize the actuation devices 182*a*, 182*b* to actuate one or more tools, such as reamers, steering pads and/or drilling bits with moveable blades, by selectively flowing of a fluid. Accordingly, the actuation devices 182*a*, 182*b* provide actuation to one or more downhole apparatus or tools 160*a*, 160*b*, wherein the device is controlled remotely, at the surface, or locally by controllers 184*a*, 184*b*.

Figure 2A:
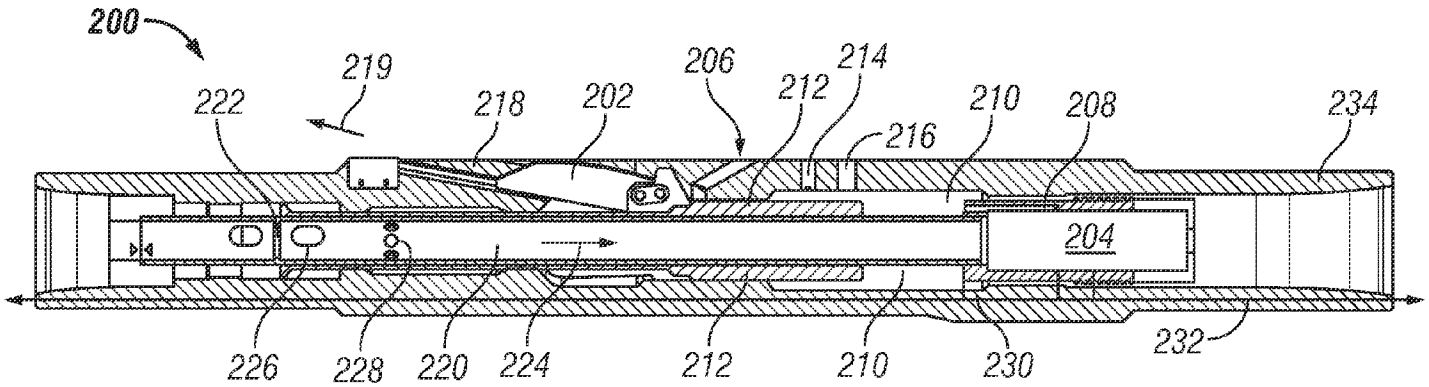
FIGS. 2A and 2B are sectional side views of an embodiment a portion of a drill string, a tool and an actuation device, wherein the tool is depicted in two positions, according to an embodiment of the present disclosure.
Figure 2B:
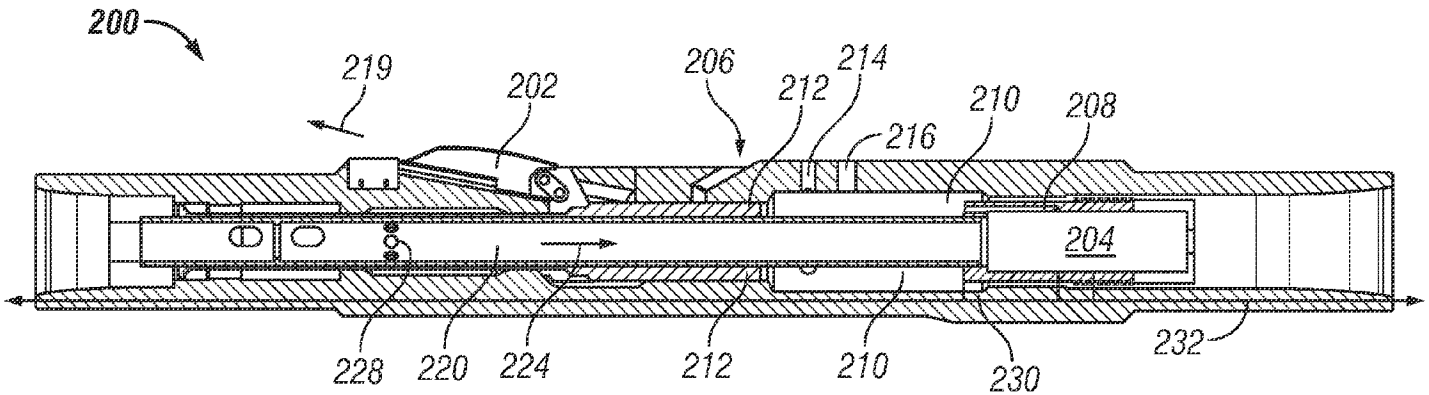
Figure 3A:
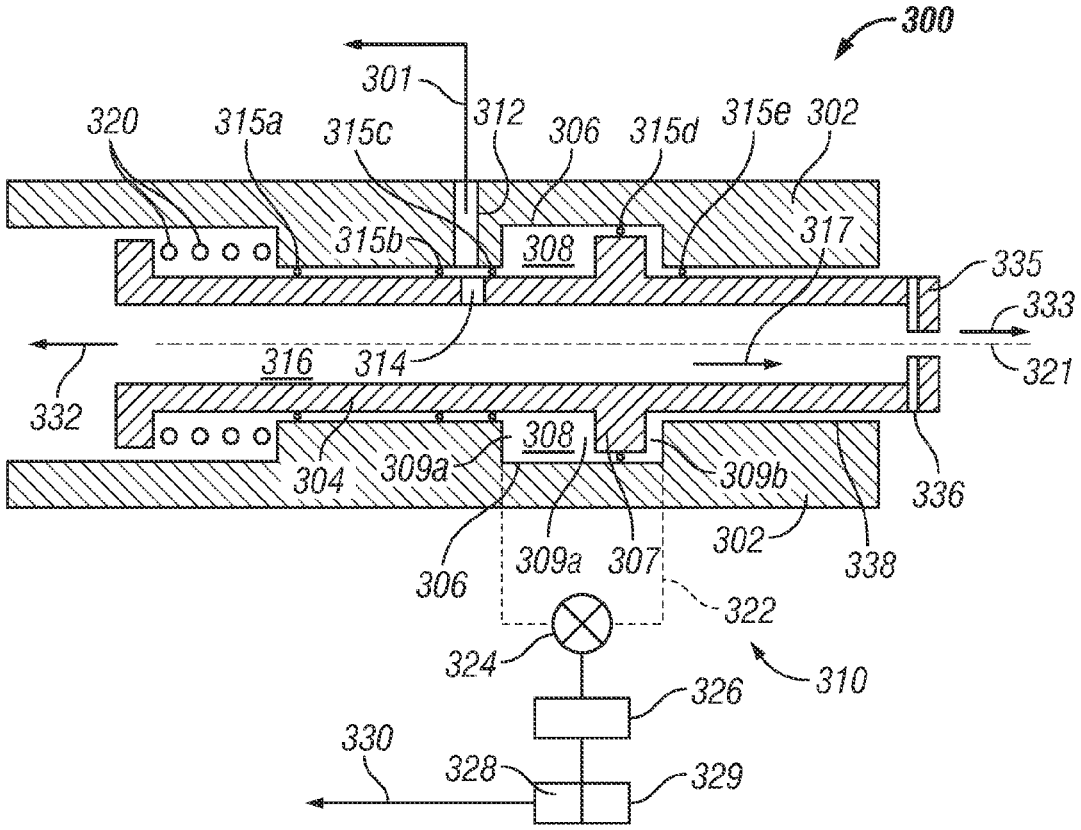
FIGS. 3A and 3B are sectional schematic views of an actuation device in two states or positions, according to an embodiment of the present disclosure.
Figure 3B:
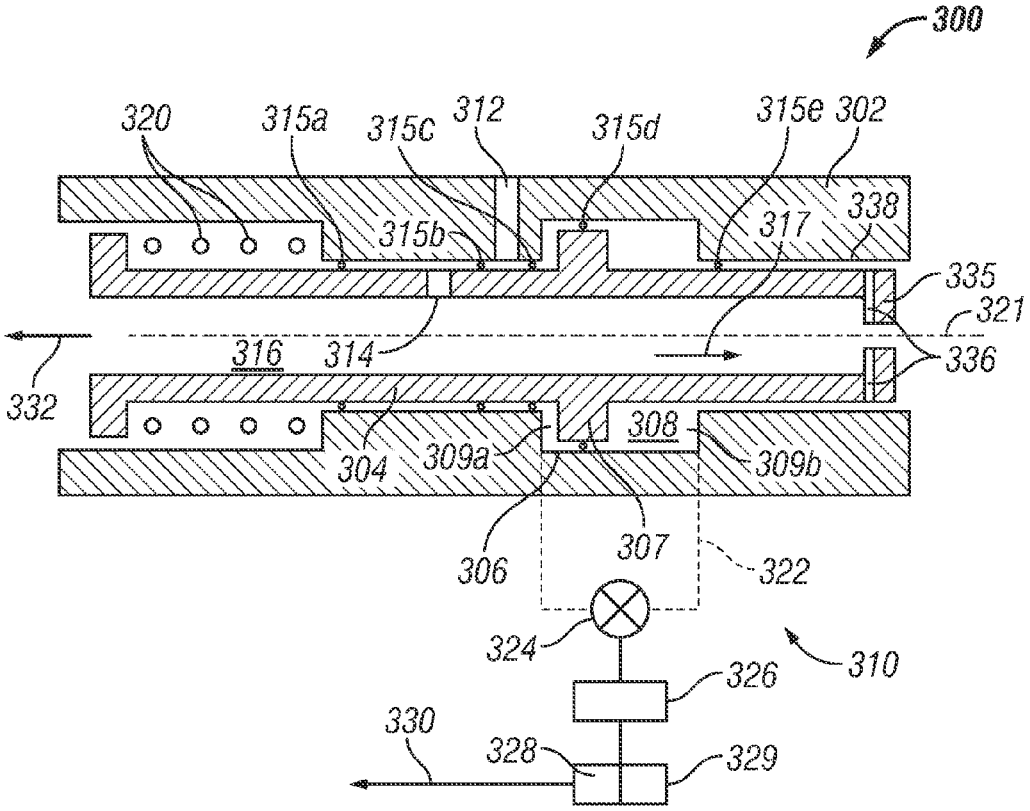

FIGS. 2A and 2B are sectional side views of an embodiment a portion of a drill string, a tool and an actuation device, wherein the tool is depicted in two positions. FIG. 2A shows a tool 200 with a reamer 202 in a retracted (also referred to as "inactive" position or "closed" position). FIG. 2B shows the tool 200 with reamer 202 in an extended position (also referred to as "active" position or "open" position). The tool 200 includes an actuation device 204 configured to change positions or states of the reamer 202. The depicted tool 200 shows a single reamer 202 and actuation device 204, however, the concepts discussed herein may apply to embodiments with a plurality of tools 200, reamers 202 and/or actuation devices 204. For example, a single actuation device 204 can actuate a plurality of reamers 202 in a tool 200, wherein the actuation device 204 controls fluid flow to the reamers 202. As shown, the actuation device 204 is schematically depicted as a functional block, however, greater detail is shown in FIGS. 3A and 3B. In an aspect, the reamer 202 includes or is coupled to an actuation assembly 206, wherein the actuation device 204 and the actuation assembly 206 causes reamer 202 movement. Line 208 provides fluid communication between actuation device 204 and the actuation assembly 206. The actuation assembly 206 includes a chamber 210, sliding sleeve 212, bleed nozzle 214 and check valve 216. The sliding sleeve 212 (or annular piston) is coupled to the blade of reamer 202, wherein the reamer 202 may extend and retract along actuation track 218. In an aspect, the reamer 202 includes abrasive members, such as cutters configured to destroy a wellbore wall, thereby enlarging the wall diameter. The reamer 202 may extend to contact a wellbore wall as shown by arrow 219 and in FIG. 2B.

Still referring to FIGS. 2A and 2B, in an aspect, drilling fluid 224 flows through a sleeve 220, wherein the sleeve 220 includes a flow orifice 222, flow bypass port 226, and nozzle ports 228. In one aspect, the actuation device 204 is electronically coupled to a controller located uphole via a line 230. As described below, the actuation device 204 may include a controller configured for local control of the device. Further, the actuation device 204 may be coupled to other devices, sensors and/or controllers downhole, as shown by line 232. For example, tool end 234 may be coupled to a BHA, wherein the line 232 communicates with devices and sensors located in the BHA. As depicted, the line 230 may be coupled to sensors that enable surface control of the actuation device 204 via signals generated uphole that communicate commands including the desired position of the reamer 202. In one aspect, the line 232 is coupled to accelerometers that detect patterns in the drill string rotation rate, or RPM, wherein the pattern is decoded for commands to control one or more actuation device 204. Further, an operator may use the line 230 to alter the position based on a condition, such as drilling a deviated wellbore at a selected angle. For example, a signal from the surface controller may extend the reamer 202, as shown in FIG. 2B, during drilling of a deviated wellbore at an angle of 15 degrees, wherein the extended reamer 202 provides stability while also increasing the wellbore diameter. It should be noted that FIGS. 2A and 2B illustrate non-limiting examples of a tool or device (200, 202) that may be controlled by fluid flow from the actuation device 204, which is also described in detail with reference to FIGS. 3A and 3B.

FIGS. 3A and 3B are schematic sectional side views of an embodiment of an actuation device 300 in two positions. FIG. 3A illustrates the actuation device 300 in an active position, providing fluid flow 301 to actuate a downhole tool, as described in FIGS. 2A and 2B. FIG. 3B shows the actuation device 300 in a closed position, where there is no fluid flow to actuate the tool. In an aspect, the actuation device 300 includes a housing 302 and a piston 304 located in the housing 302. The housing 302 includes a chamber 306 where an annular member 307, extending from the piston 304, is positioned. In an aspect, the housing 302 contains a hydraulic fluid 308 such as substantially non-compressible oil. The chamber 306 may be divided into two chambers, 309*a* and 309*b*, by the annular member 307. Further, the fluid 308 may be transferred between the chambers 309*a* and 309*b* by a flow control device 310 (or locking device), thereby allowing movement of the annular member 307 within chamber 306. In an aspect, the housing 302 includes a port 312 that provides fluid communication with the line 208 (FIGS. 2A and 2B). When the piston 304 is in a selected active axial position, as shown in FIG. 3A, a port 314 enables fluid communication from a fluid flow path 316 in the piston 304 (also referred to a flow path or an annulus) to port 312 and line 208. In one aspect, a drilling fluid is pumped by surface pumps causing the fluid to flow downhole, shown by arrow 317. Accordingly, as depicted in FIG. 3A, the actuation device 300 is in an active position where drilling fluid flows from the flow path 316 through ports 314, 312 and into a supply line 208, as shown by arrow 301. In an aspect, the actuation device 300 includes a plurality of seals, such as ring seals 315*a*, 315*b*, 315*c*, 315*d* and 315*e*, where the seals restrict and enable fluid flow through selected portions of the device 300. As depicted, the flow control device 310 (also referred to as a "locking device") uses a flow of fluid to "lock" the piston 304 in a selected axial position. It should be understood that any suitable locking device may be used to control axial movement by locking and unlocking the position of annular member 307 within chamber 306. In other aspects, the locking device 310 may comprise any suitable mechanical, hydraulic or electric components, such as a solenoid or biased collet.

With continued reference to FIGS. 3A and 3B, a biasing member 320, such as a spring, is coupled to the housing 302 and piston 304. The biasing member 320 may be compressed and extended, thereby providing an axial force as the piston 304 moves along axis 321. In an aspect, the flow control device 310 is used to control axial movement of the piston 304 within the housing 302. As depicted, the flow control device 310 is a closed loop hydraulic system that includes a hydraulic line 322, a valve 324, a processor 326 and a memory device 328, and software programs 329 stored in the memory device 328 and accessible to the processor 326. The processor 326 may be a microprocessor configured to control the opening and closing of valve 324, which is in fluid communication with chambers 309*a*, 309*b*. In an embodiment, the processor 326 and memory 328 are connected by a line 330 to other devices, such as controller 140 at the surface (FIG. 1) or sensors and controller in the drill string. In other embodiments, the flow control device 310 operates independently or locally, based on the control of the processor 326, memory 328, software 329 and additional inputs, such as sensed downhole parameters and patterns within sensed parameters. In another aspect, the flow control device 310 and actuation device 300 may be controlled by a surface controller, where signals are sent downhole by a communication line, such as line 330. In another aspect, a sensor, such as an accelerometer, may sense a pattern in mud pulses, wherein the pattern communicates a command message, such as one describing a desired position for the actuation device 300. As depicted, the piston 304 includes a nozzle 335 with one or more bypass ports 336, where the nozzle 335 enables flow from the flow path 316 downhole.

The operation of the actuation device 300 in reference to FIGS. 3A and 3B, is discussed in detail below. FIG. 3A shows the actuation device 300 in an active position. The device 300 moves to an active position when drilling fluid flowing downhole 317 causes an axial force in the flow direction, pushing the piston 304 axially 333, as it flows through the restricted volume of nozzle 335. In an embodiment, the fluid flow axial force is greater than the resisting spring force of biasing member 320, thereby compressing the biasing member 320 as the piston moves in direction 333. In addition, the valve 324 is opened to allow hydraulic fluid to flow from chamber 309*b*, substantially filling chamber 309*a*. This enables movement of annular member 307 in chamber 306, thereby enabling the piston 304 to move axially 333. Accordingly, as the valve 324 is opened (or unlocked) the flow of drilling fluid, controlled uphole by mud pumps, provides an axial force to move piston 304 to the active position. As the chamber 309*a* is substantially full and chamber 309*b* is substantially empty, the valve 324 is closed or locked, thereby enabling the ports 312 and 314 to align and provide a flow path. In the active position, the drilling fluid flows through the nozzle 335 and bypass ports 336, as flow from the ports 336 is not restricted by inner surface 338. Accordingly, in the active position, the actuation device 300 provides fluid flow 301 to actuate one or more downhole tools, such as reamer 202 shown in FIG. 2B.

As shown in FIG. 3B, the actuation device 300 is in a closed position, where the piston 304 has been moved axially 332 by the flow control device 310 and biasing member 320, thereby stopping a flow of drilling fluid from the flow path 316 through ports 314 and 312. To move to the closed position, the valve 324 is opened to enable hydraulic fluid to flow from chamber 309*a* to chamber 309*b*, thereby unlocking the position annular member 307 within chamber 306 and enabling the piston 304 to move axially 332. In addition, the flow of drilling fluid 317 is reduced or stopped to allow the force of biasing member 320 to cause piston 304 to move axially 332. Once the piston 304 is in the desired closed position, where the ports 312 and 314 are not in fluid communication with each other, the valve 324 is closed to lock the piston 304 in place. In the closed position, the chamber 309*a* is substantially empty and the chamber 309*b* is substantially full. In addition, in the closed position of actuation device 300, drilling fluid does not flow through the bypass ports 336, which are restricted by inner surface 338. Thus, the actuation device 300 in a closed position shuts off fluid flow and corresponding actuation to one or more tools operationally coupled to the device, thereby keeping the tool, such as a reamer 202 (FIG. 2A) in a neutral position.

Referring back to FIG. 1, in an aspect, one or more downhole devices or tools, such as the reamers 180*a*, 180*b*, are controlled by and communicate with the surface via pattern recognition signals transmitted through the drill string. The signal patterns may be any suitable robust signal that allows communication between the surface drilling rig and the downhole tool, such as changes in drill string rotation rate (revolutions per minute or "RPM") or changes in mud pulse frequency. In an aspect, the sequence, rotation rate speed (RPM) and duration of the rotation is considered a pattern or pattern command that is detected downhole to control one or more downhole tools. For example, the drill string may be rotated at 40 RPM for 10 seconds, followed by a rotation of 20 RPM for 30 seconds, where one or more sensors, such as accelerometers or other sensors, sense the drill string rotation speed and route such detected speeds and corresponding signals to a processor 326 (FIGS. 3A and 3B). The processor 326 decodes the pattern to determine the selected tool position sent from the surface and then the actuation device 300 (FIGS. 3A and 3B) causes the tool to move to the desired position. In another aspect, a sequence of mud pulses of a varying parameter, such as duration, amplitude and/or frequency may provide a command pattern received by pressure sensors to control one or more downhole devices. In aspects, a plurality of downhole tools may be controlled by pattern commands, wherein a first pattern sequence triggers a first tool to position A and a second pattern sequence triggers a second tool to second position B. In the example, the first and second patterns may be RPM and/or pulse patterns that communicate specific commands to two separate tools downhole. Thus, RPM pattern sequences and/or pulse pattern sequences in combination with a tool and actuation device, such as the actuation device described above, and sensors enable communication with and improved control of one or more downhole devices.

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

The invention claimed is:

1. An apparatus for use downhole, comprising:

a downhole device;

an actuation device configured to actuate the downhole device, the actuation device including:

a chamber configured to contain a first fluid therein;

a movable member that divides the chamber into a first chamber section and a second chamber section; and a flow control device configured to allow the first fluid to move between the first chamber section and the second chamber section, wherein the movable member moves in the chamber by a force supplied by a second fluid, wherein when the first fluid is moved into the first chamber section, the second fluid is supplied to activate the downhole device, and when the first fluid is moved into the second chamber section, supply of the second fluid is stopped, wherein stopping the supply of the second fluid causes the downhole device to deactivate.

2. The apparatus of claim 1, wherein the chamber is formed between a housing and the movable member.

3. The apparatus of claim 1, wherein the movable member includes a through passage for flow of the second fluid therethrough and wherein the second fluid moves the movable member from an inactive position in which the supply of the second fluid stopped to an active position in which the second fluid is supplied to activate the downhole device.

4. The apparatus of claim 1 further comprising a biasing member configured to move the movable member from an active position to an inactive position when the first fluid is moved into the second chamber section.

5. The apparatus of claim 1 further comprising a telemetry unit configured to send to the flow control device a first command signal to activate the downhole device and a second command signal to deactivate the downhole device, wherein the each command signal comprises a pattern recognition signal.

6. The apparatus of claim 5, wherein the telemetry unit sends the signals to the flow control device via rotation of a tubular.

7. The apparatus of claim 1, wherein the flow control device includes a processor configured to activate and deactivate the actuation device in response to command signals received from a remote location.

8. The apparatus of claim 1, wherein the downhole device is selected from the group consisting of: a reamer; a force application member configured to apply force to a wellbore wall; an anchor configured to clamp the downhole device to a wellbore; an adjustable stabilizer; and a circulating device configured to divert fluid from a flow path.

9. A method of performing a downhole operation, comprising:

providing a downhole device in a wellbore that is configured to attain an activated state and a deactivated state;

providing an actuation device that includes a first chamber and a second chamber, separated by a movable member, wherein when a first fluid is moved into the first chamber, a second fluid is supplied to activate the downhole device and when the first fluid is moved into the second chamber, the supply of the second fluid is stopped to cause the downhole device to deactivate; and using a force supplied by a second fluid to move the movable member to selectively move the first fluid between the first chamber and second chamber to selectively activate and deactivate the downhole device.

10. The method of claim 9 further comprising controlling operation of the actuation device by a processor deployed downhole.

11. The method of claim 10 further comprising initiating enabling movement of the first fluid between the first chamber and the second chamber in response to signals sent from a remote location.

12. The method of claim 11, wherein the signals correspond to rotation of a tubular coupled to the downhole device.

13. The method of claim 11, wherein the signals comprise pattern recognition signals.

14. The method of claim 11, wherein providing the downhole device comprises providing a device selected from the group consisting of: a reamer; a force application member configured to apply force to a wellbore wall; an anchor configured to clamp the downhole device to a wellbore; and an adjustable stabilizer.

15. An apparatus for controlling a downhole device, comprising:

a tubular housing including an annular chamber and a first port in fluid communication with the downhole device to activate the downhole device;

a piston configured to move axially inside the tubular housing, wherein the piston and the tubular housing are coupled by a biasing member, the piston comprising:

a flow path for flow of drilling fluid through the piston;

a second port configured to enable fluid communication from the flow path to the first port at a selected axial position of the piston;

an annular member within the annular chamber of the tubular housing to seal two portions of the annular chamber into a first chamber and a second chamber, wherein the annular member is movable within the annular chamber via a force supplied by the drilling fluid flowing through the piston; and a flow control device configured to change an amount of fluid in the first and second chambers based on command signals.

16. The apparatus of claim 15 further comprising a telemetry unit configured to send the command signals to the flow control device from a remote location.

17. The apparatus of claim 15, wherein the command signals comprise pattern recognition signals transmitted by the telemetry unit via a tubular coupled to the downhole device.

18. The apparatus of claim 15, wherein the downhole device is selected from the group consisting of: a reamer; a force application member configured to apply force to a wellbore wall; an anchor configured to clamp the downhole device to a wellbore; an adjustable stabilizer; and a circulating device configured to divert fluid from a flow path.

19. An actuation device for use downhole, comprising:

a housing including an annular chamber and a first port in fluid communication with a chamber of a tool;

a locking device; and a piston configured to move axially inside the housing, wherein the piston and housing are coupled by a biasing member, the piston comprising:

an flow path for flow of drilling fluid through the piston;

a nozzle at one end of the piston, the nozzle being configured to utilize a flow of drilling fluid to provide an axial force to the piston;

a second port configured to enable fluid communication from the flow path to the first port at a selected axial position of the piston; and an annular member configured to be positioned within the annular chamber of the tubular housing, wherein the axial force on the piston provides an axial movement of the annular member within the annular chamber and the locking device is configured to control the axial movement of the piston by selectively locking and unlocking movement of the annular member within the annular chamber.

20. The device of claim 19, wherein the annular member sealingly divides the annular chamber into a first chamber and a second chamber, and wherein the locking device comprises a flow control device in fluid communication with the first and second chambers to lock and unlock the annular member by controlling an amount of fluid in the first and second chambers.

* * * * *